US007574946B1

(12) United States Patent
Chang

(10) Patent No.: US 7,574,946 B1
(45) Date of Patent: Aug. 18, 2009

(54) MAGNETIC ASSEMBLY OF A SCREWDRIVER HEAD ROD

(76) Inventor: Wun-Hai Chang, No. 11, Lane 48 Sijhou Rd., Taiping City, Taichung County (TW)

( * ) Notice: Subject to any disclaimer, the term of this patent is extended or adjusted under 35 U.S.C. 154(b) by 36 days.

(21) Appl. No.: 12/051,066

(22) Filed: Mar. 19, 2008

(51) Int. Cl.
*B25B 23/08* (2006.01)

(52) U.S. Cl. ..... 81/451; 81/52; 81/177.85; 81/438

(58) Field of Classification Search ..... 81/52, 81/125, 177.85, 438, 451
See application file for complete search history.

(56) References Cited

U.S. PATENT DOCUMENTS 7,107,882 B1 * 9/2006 Chang ..... 81/451
7,387,054 B2 * 6/2008 Rajotte ..... 81/429
2008/0216618 A1 * 9/2008 Chen ..... 81/451

* cited by examiner

*Primary Examiner*—Joseph J Hail, III
*Assistant Examiner*—Shantese McDonald
(74) *Attorney, Agent, or Firm*—Egbert Law Offices PLLC

(57) ABSTRACT

The present invention provides an improved magnetic assembly of a screwdriver head rod. The assembly includes a cylindrical body, available with a trepan boring for sleeving onto the screwdriver head rod. The first end of the cylindrical body is provided with a magnetic body groove. A magnetic body is assembled into the magnetic body groove. At least two flexible locating detents are prefabricated onto the second end of the cylindrical body. The flexible locating detent has a flexible section and locating flange. The locating flange is protruded into the trepan boring of the cylindrical body. It is possible to preserve the components of magnetic assembly, reduce the manufacturing costs, and improve the assembly performance and endurance with better industrial benefits and applicability.

2 Claims, 6 Drawing Sheets

MAGNETIC ASSEMBLY OF A SCREWDRIVER HEAD ROD

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to an assembly structure of a screwdriver head rod, and more particularly to an innovative screwdriver head rod with a magnetic assembly.

2. Description of Related Art Including Information Disclosed Under 37 CFR 1.97 and 37 CFR 1.98

When the head of traditional screwdriver is inserted into the groove of screw head, poor binding tightness between the screw head and the screwdriver will likely lead to dropping the screw during work. Even a magnetic property of a screwdriver head cannot resolve the problem due to the weakness and temporary nature of the magnetic force.

For this reason, the inventor has developed a sliding magnetic mechanism as disclosed in FIG. 1, which comprises a cylindrical main body 10, available with a trepan boring 11 for sleeving externally onto the screwdriver head rod 20 for sliding. The head of cylindrical main body 10 is provided with a magnetic body 30, and an assembly space 12 is formed within the trepan boring 11 of the cylindrical main body 10. The assembly space 12 is provided with a stop flange 13. A through-hole 31 is arranged at the center of the magnetic body 30, allowing for sleeving onto the perimeter of screwdriver head rod 20. A conical spring 14 is arranged within the assembly space 12 of the cylindrical main body 10. The expanded end 141 of the conical spring 14 is limited at the stop flange 13 of the assembly space 12, and the reducing end 142 is limited at the groove 21 of screwdriver head rod 20, thus eliminating any slippage of cylindrical main body 10.

However, there are the following shortcomings of typical structure observed during actual applications. As the limitation of a conventional magnetic assembly is implemented through an additional conical spring 14, this assembly will increase the material cost at the manufacturing level. The conical spring 14 must be manually incorporated between the assembly space 12 of cylindrical main body 10 and the groove 21 of screwdriver head rod 20, leading to higher assembly costs. Moreover, during the assembly process of said conical spring 14, the reducing end 142 is supported forcibly to get across one end of screwdriver head rod 20, bringing about great possibility of damage, deformation and defect, and making it difficult for quality control. From the perspective of the users, the conical spring 14 presents poor endurance due to vulnerability to rustiness, jamming and elastic fatigue/damage after a period of time.

Thus, to overcome the aforementioned problems of the prior art, it would be an advancement in the art to provide an improved structure that can significantly improve efficacy.

Therefore, the inventor has provided the present invention of practicability after deliberate design and evaluation based on years of experience in the production, development and design of related products.

BRIEF SUMMARY OF THE INVENTION

The enhanced efficacy of the present invention is as follows:

Based upon an innovative structure of the present invention, flexible locating detents are prefabricated onto the cylindrical body of the magnetic assembly, the conical spring being protected as compared to the prior art. Moreover, the cylindrical body is directly assembled into the screwdriver head rod, thereby preventing slippage, reducing the manufacturing cost and improving the assembly performance with better industrial benefits.

As the flexible locating detents are prefabricated onto the cylindrical body of the magnetic assembly, excellent structural strength enables stronger endurance of the magnetic assembly, thus extending the service life with improved applicability.

There are also improvements brought about by this invention.

Based upon the structure of the present invention, a raised ring is formed at the notch of the magnetic body's groove of the cylindrical body, and a chamfered ring is arranged around the corresponding end of the magnetic body to mate with the raised ring. The magnetic body is assembled securely into the magnetic body's groove without slippage, thus allowing for more convenient and efficient assembly.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
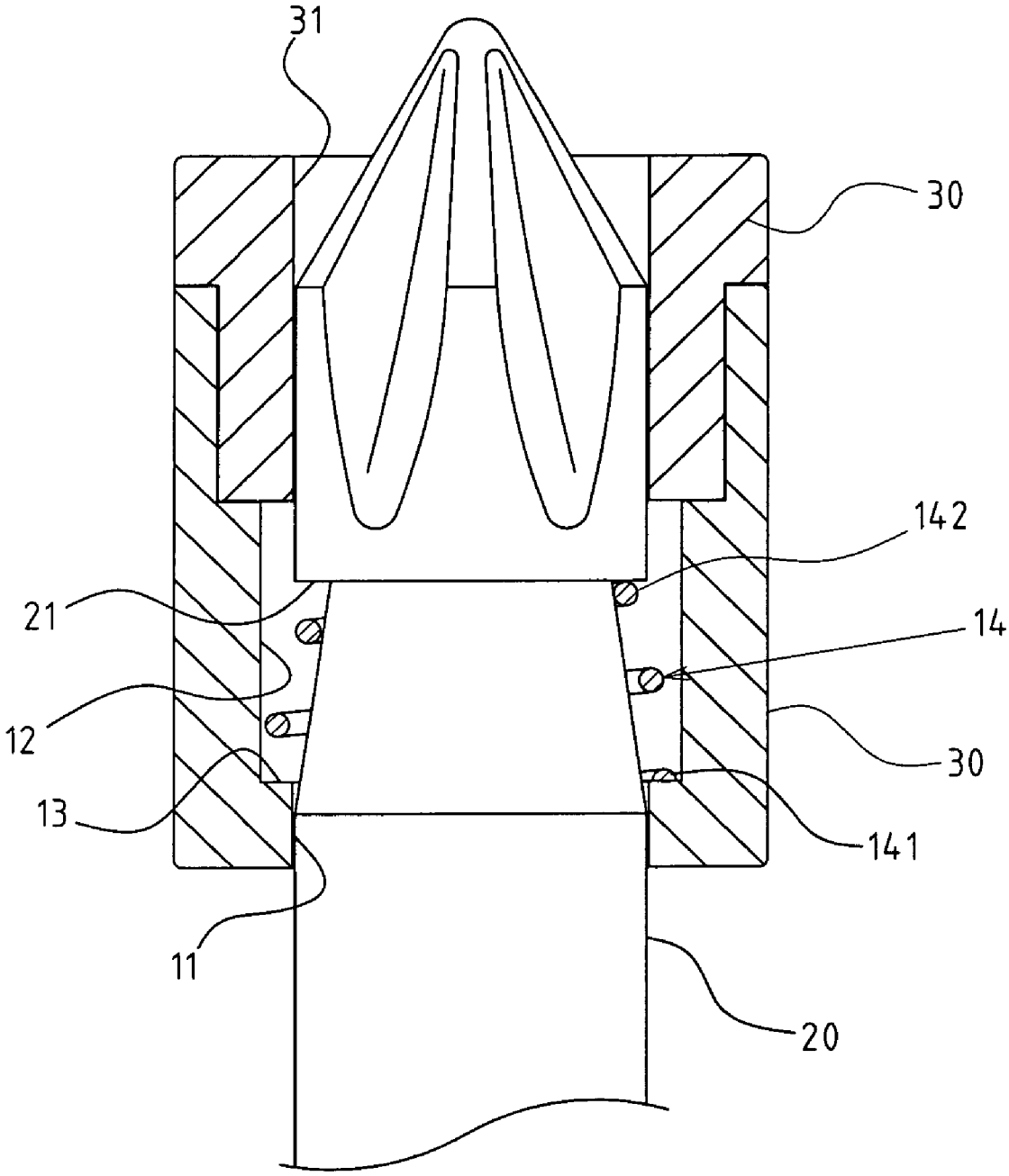
FIG.1 PRIOR ART
FIG. 1 shows an assembled sectional view of a typical prior art structure.

The features and the advantages of the present invention will be more readily understood upon a thoughtful deliberation of the following detailed description of a preferred embodiment of the present invention with reference to the accompanying drawings.

FIGS. 2-5 depict preferred embodiments of the magnetic assembly of screwdriver head rod of the present invention. The embodiments are provided only for explanatory purposes with respect to the patent claims.

The magnetic assembly A comprises a cylindrical body 40, available with a trepan boring 41 for sleeving onto the screwdriver head rod 50. The first end of the cylindrical body 40 is provided with a magnetic body's groove 42.

A magnetic body 60 is assembled into the magnetic body's groove 42 of the aforementioned cylindrical body 40.

At least two flexible locating detents 70 are prefabricated onto the second end of the cylindrical body 40. The flexible locating detent 70 comprises flexible section 71 and locating flange 72. The locating flange 72 is protruded into the trepan boring 41 of the cylindrical body 40.

A raised ring 43 of a triangular cross-section is formed at the notch of magnetic body's groove 42 of the cylindrical body 40, so that a chamfered ring 61 is arranged around the corresponding end of the magnetic body 60 to mate with the raised ring 43.

The cylindrical body 40 is made of plastic materials by means of ejection molding. A few transverse grooves 44 are arranged at intervals along the extension direction at the second direction of the cylindrical body 40, so that the flexible locating detent 70 (e.g. three or four detents) are formed between transverse grooves 44.

A conical ring groove 51 is placed at predefined location of the screwdriver head rod 50, then a stop wall 53 nearby the end 52 of the screwdriver head rod 50 is formed on the conical ring groove 51, so that the locating flange 72 of the flexible locating detent 70 could be limited at the stop wall 53, enabling the fixation of magnetic assembly A without slippage.

Figure 6:
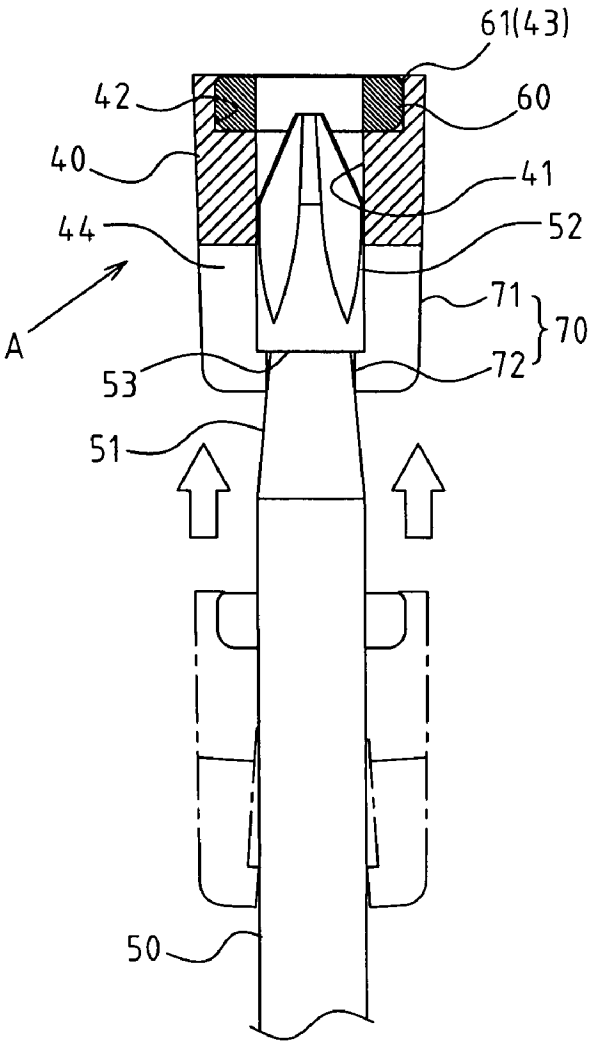
FIG. 6 shows a perspective view of the operation of the present invention.
Figure 5:
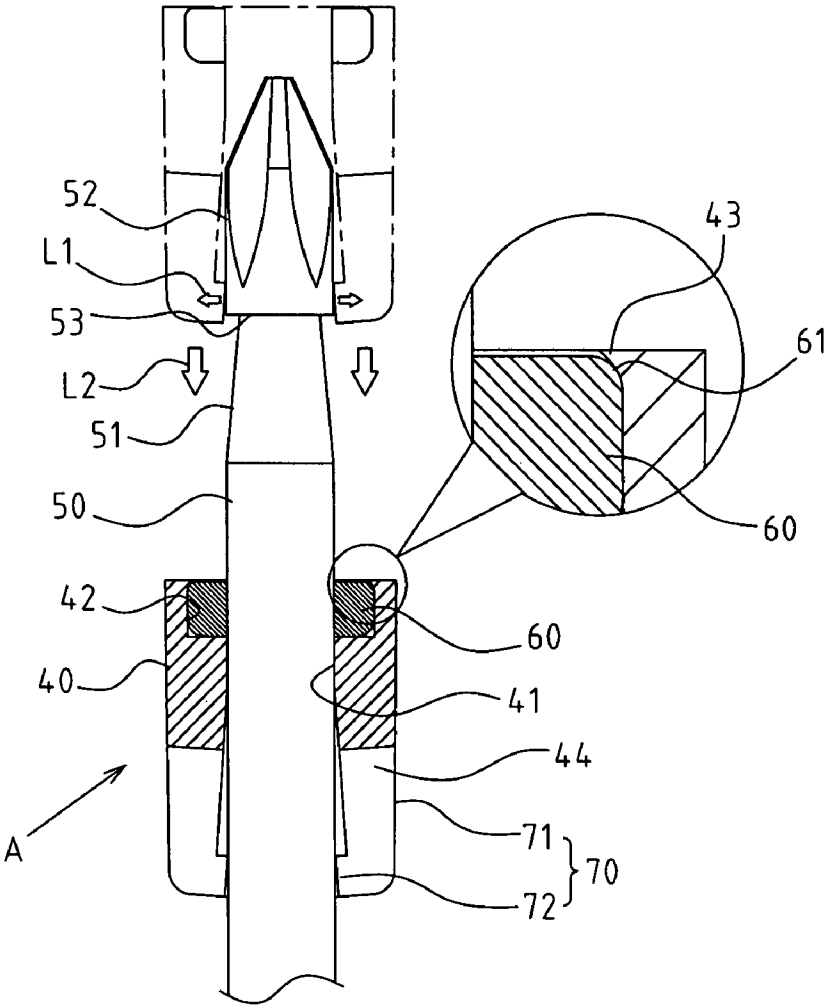
FIG. 5 shows an assembled sectional view of preferred embodiment of the present invention.

Based upon above-specified structures, the present invention is operated as follows:

Referring to FIG. 5, when the magnetic assembly A is incorporated into the screwdriver head rod 50, the flexible locating detent 70 of the cylindrical body 40 is flexibly supported outwards (shown by arrow L1), so that the cylindrical body 40 can forcibly get across the end 52 of the screwdriver head rod 50, and slide towards the body of screwdriver head rod 50 (shown by arrow L2). Referring also to FIG. 6, when the cylindrical body 40 slides to the conical ring groove 51 of the screwdriver head rod 50, the locating flange 72 of the flexible locating detent 70 could be locked at the stop wall 52 at one end of the conical ring groove 51, thereby providing limitation to prevent slippage of magnetic assembly A.

The magnetic assembly A is used to enhance the stability of sucking the screw by the screwdriver head rod 50, making it possible to loosen or tighten the screw more smoothly, and also prevent any dropping of screws. On the other hand, when the screws or other conductive parts fall down on the ground or in the seam, the magnetic assembly A could be used for a sucking purpose.

Figure 2:
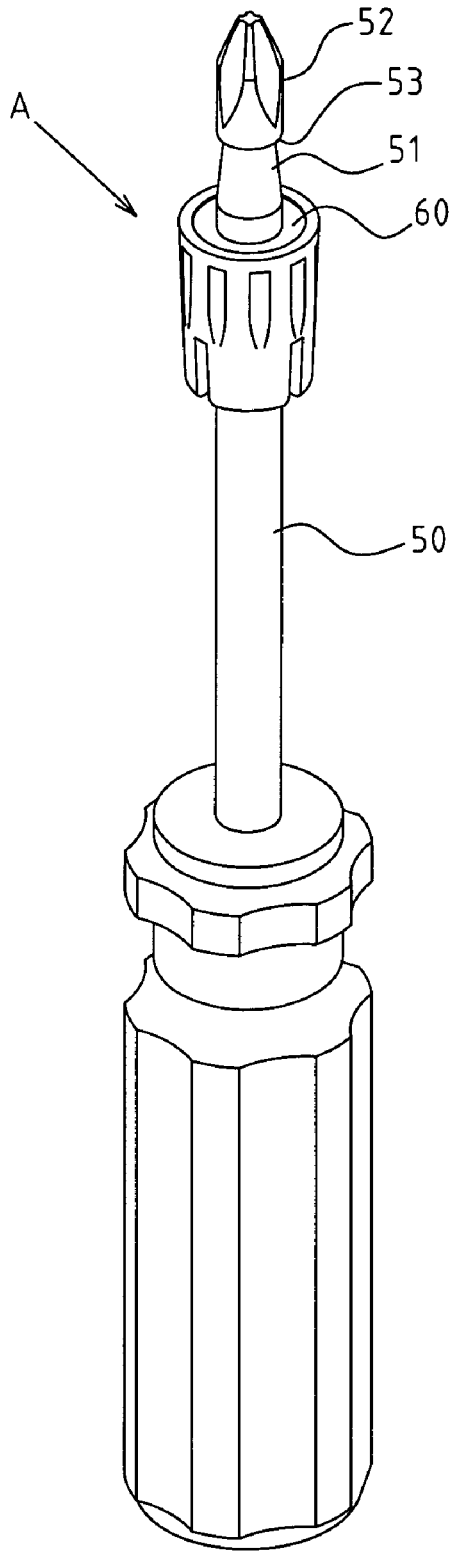
FIG. 2 shows an assembled perspective view of preferred embodiment of the present invention.
Figure 3:
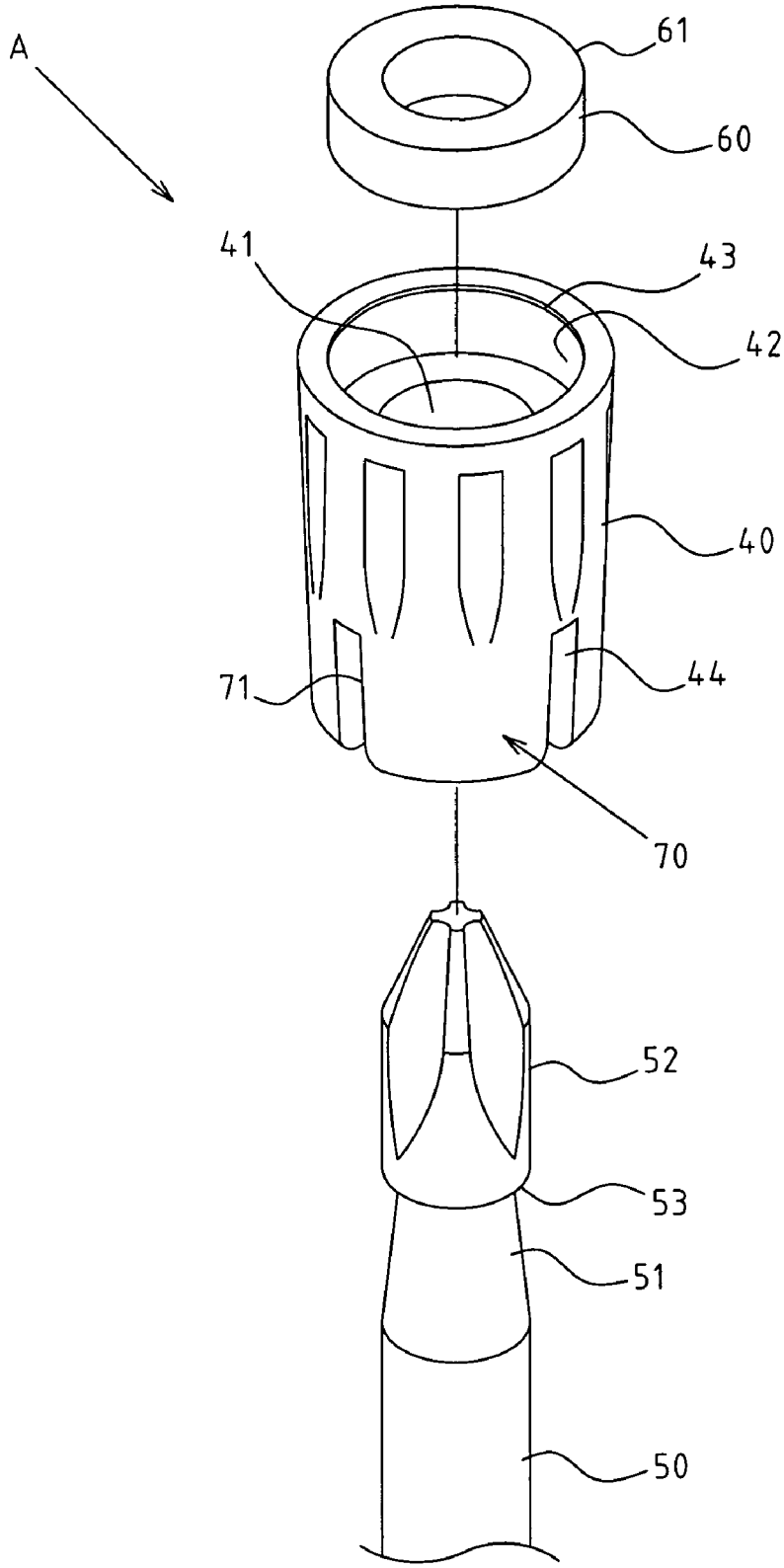
FIG. 3 shows an exploded perspective view of preferred embodiment of the present invention.
Figure 4:
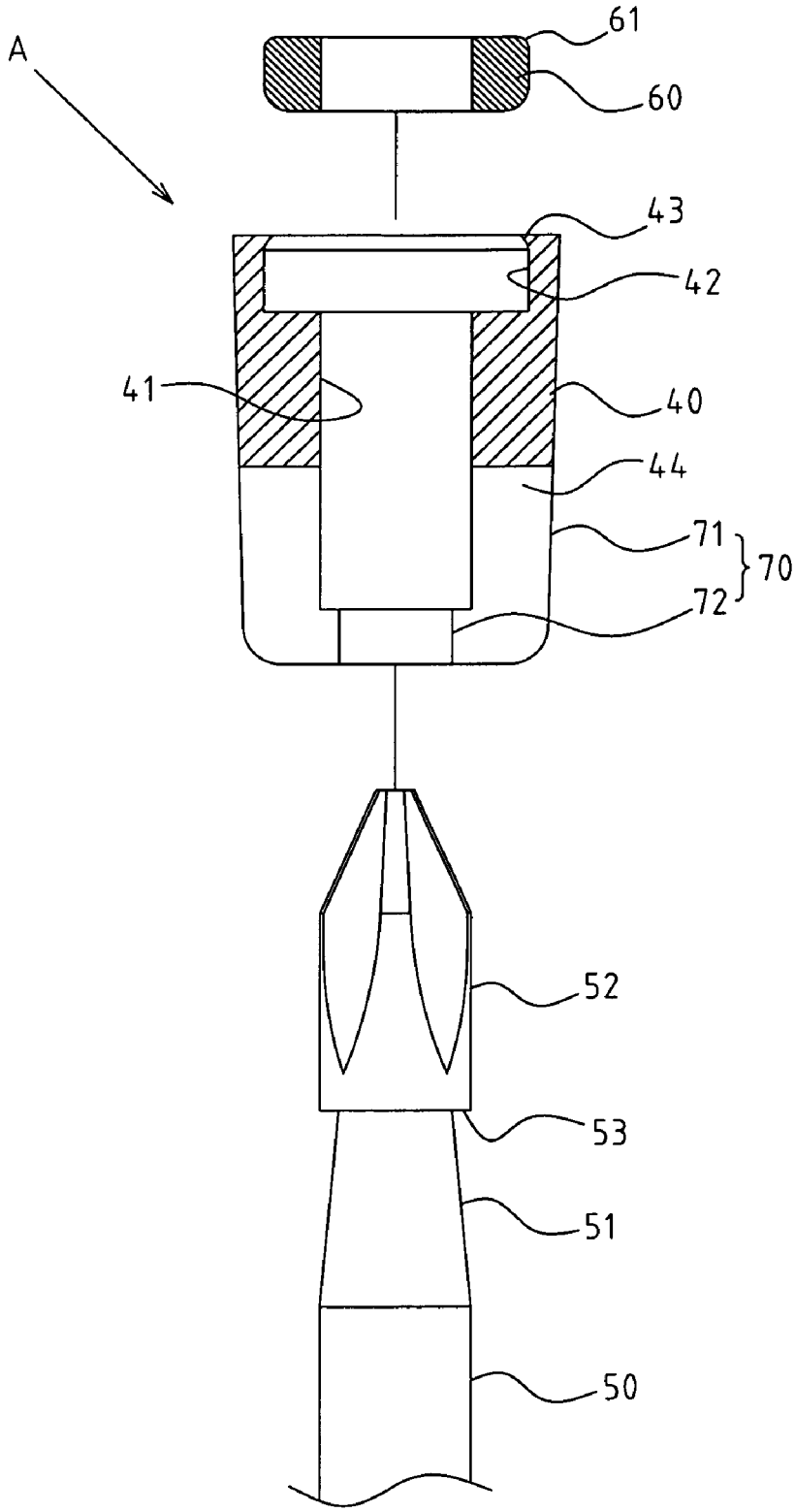
FIG. 4 shows an exploded sectional view of preferred embodiment of the present invention.
Figure 7:
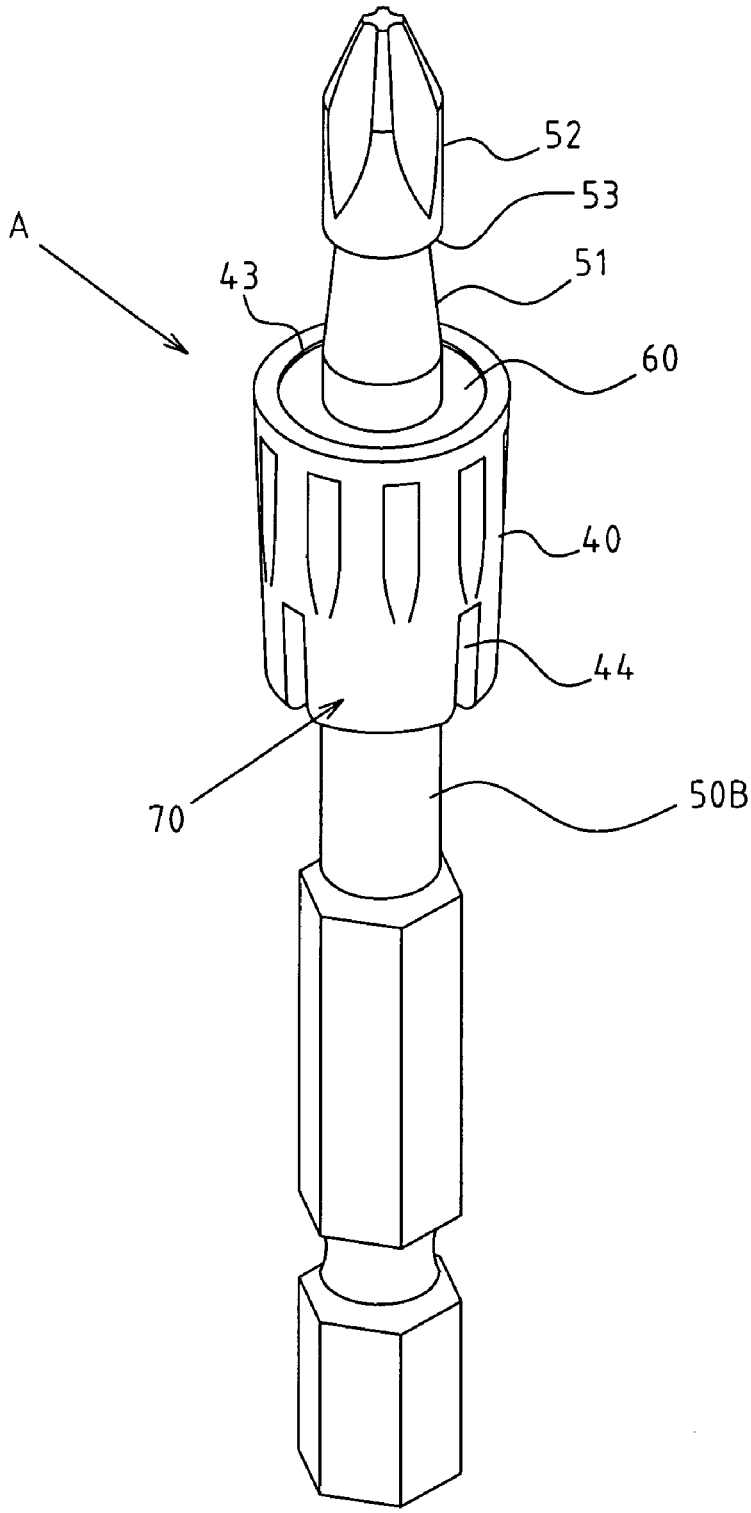
FIG. 7 shows a schematic view of magnetic assembly of the present invention which is applied to electric screwdriver head rod.

Additionally, the magnetic assembly A of the present invention could be assembled onto the manual screwdriver head rod 50 as shown in FIG. 2, or assembled onto the electric screwdriver head rod 50B as shown in FIG. 7, serving the same purpose of sucking the screws stably.

I claim:

1. An apparatus comprising:

a screwdriver having a head rod with a screwdriver head at an end thereof, said screwdriver head having a stop wall at an end thereof, said head rod having a conical ring groove converging toward said stop wall;

a cylinder body having a trepan boring sleeved onto said head rod, said cylindrical body having a ring groove adjacent one end thereof, said cylindrical body being of an injection molded polymeric material, said cylindrical body having a plurality of transverse grooves formed through a wall of said cylindrical body and extending in spaced-relation to each other around said wall of said cylindrical body, said plurality of transverse grooves extending inwardly from an opposite end of said cylindrical body;

a magnetic body having an annular shape and affixed within said ring groove; and a pair of flexible locating detents formed at said opposite end of said cylindrical body, each of said pair of flexible locating detents comprising a flexible section and a locating flange, said locating flange protruding into said trepan boring of said cylindrical body, said locating flange contacting said stop wall when said cylindrical body is in a position such that said magnetic body extends outwardly of said screwdriver head, said locating flange extending around said conical ring groove.

2. The apparatus of claim 1, said cylindrical body having a raised ring of triangular cross-section formed at one end of said cylindrical body adjacent to and extending radially inwardly of said ring groove, said magnetic body having a chamfered ring formed at an end thereof and in mating relation with said raised ring.

* * * * *